US009921021B1

(12) United States Patent
Graham, II

(10) Patent No.: US 9,921,021 B1
(45) Date of Patent: Mar. 20, 2018

(54) FIREARM ATTACHMENT LOCKING SYSTEMS AND METHODS

(71) Applicant: Henry L. Graham, II, Zirconia, NC (US)

(72) Inventor: Henry L. Graham, II, Zirconia, NC (US)

(73) Assignee: Rugged Design, Inc., Travelers Rest, SC (US)

( * ) Notice: Subject to any disclaimer, the term of this patent is extended or adjusted under 35 U.S.C. 154(b) by 0 days.

(21) Appl. No.: 14/982,098

(22) Filed: Dec. 29, 2015

(51) Int. Cl.
*F41A 21/32* (2006.01)
*F41A 21/30* (2006.01)

(52) U.S. Cl.
CPC ..... *F41A 21/325* (2013.01); *F41A 21/30* (2013.01)

(58) Field of Classification Search
CPC ..... F41A 21/00; F41A 21/30; F41A 21/32; F41A 21/325; F41A 21/34; F41A 21/36; F41A 21/38; F41A 21/48
See application file for complete search history.

(56) References Cited

U.S. PATENT DOCUMENTS 7,661,349 B1 * 2/2010 Brittingham ..... F41A 21/30 181/223
7,789,009 B1 * 9/2010 Brittingham ..... F41A 21/30 181/223
8,490,535 B1 * 7/2013 Moore ..... F41A 21/30 181/223
8,499,676 B1 * 8/2013 Moore ..... F41A 21/325 42/90
8,555,765 B2 * 10/2013 Graham, II ..... F41A 21/325 285/92
8,997,621 B1 * 4/2015 Dater ..... F41A 21/325 89/14.3
9,500,427 B1 * 11/2016 Larue ..... F41A 21/30
9,513,078 B1 * 12/2016 Fulton ..... F41A 21/325
2001/0049996 A1 * 12/2001 Fluhr ..... F41A 21/30 89/14.4
2006/0060076 A1 * 3/2006 Dueck ..... F41A 21/30 89/14.4

(Continued)

*Primary Examiner* — Derrick R Morgan
(74) *Attorney, Agent, or Firm* — Smith Moore Leatherwood LLP; Thomas W. Epting

(57) ABSTRACT

The invention relates to devices for attaching or detaching a sound suppressor or an auxiliary device to a firearm. The device has a mount body that is attached by threads to a muzzle attachment device that is attached to the muzzle of a firearm. The muzzle attachment device has external mounting threads, a gas seal, an engagement surface, and a locking surface on the rear of the muzzle attachment device. The engagement surface simultaneously provides an alignment function and a forward locking function. A rotating collar is attached by threads to the mount body, and a locking spring with locking surfaces is attached to the mount body by threads, with the locking spring fitting inside the rotating collar. The rotating collar, when rotated, forces the locking spring and its locking surfaces downwards against the rear locking surface on the muzzle attachment device, providing force against the rear locking surface and securing the sound suppressor or auxiliary device to the muzzle attachment device through the combination of the forward engagement surface and the rear locking surface.

39 Claims, 12 Drawing Sheets

(56) References Cited

U.S. PATENT DOCUMENTS

| | | | | |
|---|---|---|---|---|
| 2010/0139145 | A1* | 6/2010 | Brittingham | F41A 21/325 42/90 |
| 2010/0275493 | A1* | 11/2010 | Polovnev | F41A 21/34 42/90 |
| 2010/0313743 | A1* | 12/2010 | Dueck | F41A 21/325 89/14.05 |
| 2011/0067950 | A1* | 3/2011 | Shults | F41A 21/30 181/223 |
| 2012/0180623 | A1* | 7/2012 | Graham, II | F41A 21/325 89/14.4 |
| 2012/0272818 | A1* | 11/2012 | Dueck | F41A 21/30 89/14.4 |
| 2013/0000170 | A1* | 1/2013 | Dueck | F41A 21/26 42/1.01 |
| 2013/0133976 | A1* | 5/2013 | Johansen | F41A 21/325 181/223 |
| 2013/0180796 | A1* | 7/2013 | Dueck | F41A 21/30 181/223 |
| 2014/0020976 | A1* | 1/2014 | Shults | F41A 21/30 181/223 |
| 2014/0231168 | A1* | 8/2014 | Dueck | F41A 21/325 181/223 |
| 2014/0237881 | A1* | 8/2014 | MacK | F41A 21/325 42/90 |
| 2015/0253098 | A1* | 9/2015 | Russell | F41A 21/325 89/14.4 |
| 2016/0102935 | A1* | 4/2016 | Young | F41A 21/325 42/76.01 |
| 2017/0097205 | A1* | 4/2017 | Palu | F41A 21/30 |

* cited by examiner

FIREARM ATTACHMENT LOCKING SYSTEMS AND METHODS

BACKGROUND OF THE DISCLOSURE

This application generally relates to firearms, and more specifically to systems for sound suppressors for attaching or removing a sound suppressor or other auxiliary device to the muzzle area of a firearm.

The attachment to firearms of various muzzle attachments such as sound suppressors, blank firing adapters and other auxiliary muzzle attachments require that the muzzle attachment be secured to the firearm via a muzzle attachment device in a manner that is quick and secure. A prime requirement of a firearm attachment locking system is that the accuracy of the firearm should not be affected by the attachment or removal of the muzzle attachment. A good gas seal between the muzzle attachment and the muzzle attachment device is necessary and the method of attachment should be easy and intuitive to the user. The muzzle attachment device maybe a flash suppressor, a muzzle brake, a compensator or other devices that require attachment to a firearm's muzzle.

Known in the art are many different mounting systems that allow attachment and removal of a sound suppressor to the muzzle area of a firearm. Some of these systems use approaches such as bayonet-type push and twist, a locking collar with an eccentric opening and a spring biased secondary retention system, a coarse thread with a spring biased ratchet secondary retention system, and a rotating cam collar locking system that locks onto a knurled surface.

Most of these systems have problems, and these relate to the use of ratchet systems used with spring biased secondary retention systems. These problems include failure of the system to lock securely which leads to the suppressor becoming loose, as well as the suppressor failing to lock up in the same position when attached or re-attached. The shooter needs to be sure that fitting a sound suppressor to the firearm does not severely affect the point-of-aim/point-of-impact of the firearm.

Therefore, there is a need for a locking system that locks a muzzle attachment such as a sound suppressor to a muzzle attachment device. It is desirable that this locking system is easily used, allows the attachment and detachment of a muzzle attachment to a firearm, and does not loosen the muzzle attachment in a manner that affects point-of-impact shift. The present invention fulfils these needs and provides further related advantages as described herein.

SUMMARY OF THE INVENTION

In accordance with the purpose(s) of the invention, as embodied and broadly described herein, the invention, in one aspect, relates to firearms, and more specifically to systems, methods and devices for attaching or removing a sound suppressor or other auxiliary device to a firearm.

In one aspect, the present disclosure relates to a system for attachment of various muzzle attachments such as sound suppressors, blank firing adapters and other auxiliary muzzle attachments that require the muzzle attachment to be secured via a muzzle attachment device in a manner that is quick and secure. The firearm attachment locking system may include a rotating collar that uses at least one cam that locks the suppressor securely to the muzzle attachment device or suppressor interface upon rotation of the collar. The system has minimal point-of-impact shift on the host firearm, and utilizes surfaces to lock the suppressor to the muzzle device.

The firearm attachment locking system has a locking spring with at least one or more spring arms and when the rotating collar is rotated, the at least one cam that is part of the rotating collar forces the locking spring down and against a surface on the muzzle attachment device.

In another aspect, the present disclosure relates to a firearm attachment locking system that locks the suppressor or muzzle attachment to the muzzle attachment device, and does not loosen after use. The rotation of the locking collar moves one or more integral cam surfaces against the spring arms. The spring arms are moved down and against a surface on the muzzle attachment device, loading the spring arms and providing a constant spring pressure against the rear of the muzzle attachment device locking surface. This constant spring pressure locks the suppressor or muzzle attachment to the muzzle attachment device. When using the system, the suppressor is screwed onto the muzzle attachment device until it is unable to be rotated anymore. Then the user rotates the locking collar, and this rotation of the locking collar with its one or more integral cams forces the spring arms down and against a surface on the muzzle attachment device. The suppressor remains locked to the muzzle attachment device, and doesn't loosen after usage. This is due to the constant spring pressure acting against the locking surface on the muzzle attachment device. Removing the suppressor simply requires the rotation of the locking collar to the unlocked position, unscrewing the suppressor from the muzzle attachment device and pulling the suppressor forward and off the muzzle attachment device.

In another aspect, the present disclosure relates to a firearm attachment locking system that is secure, fast to attachment and provides a minimal effect on point-of-impact shift on the host firearm. The firearm attachment locking system requires fitting a muzzle attachment device to the firearm, the muzzle attachment device being a flash hider, a muzzle brake, a compensator or another device that requires attachment to the muzzle of a firearm. The muzzle attachment device may be provided with an external thread, and surfaces that provide a locking function when used with the firearm attachment locking system. Once the firearm attachment device is fitted to the firearm, there are no extra changes necessary to the firearm.

In another aspect, the present disclosure relates to a method of attachment of a firearm suppressor that is secure, fast to attach and detach, and provides for minimal point-of-impact shift when attached to a firearm. The method of attachment is simple and requires threading or screwing the suppressor or muzzle attachment onto the muzzle attachment device until it is securely locked up and then turning the rotating locking collar to lock the suppressor and the muzzle attachment device together, thus preventing the suppressor from moving during firing of the host firearm.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

A more complete understanding of the invention can be obtained by reference to the accompanying drawings wherein generic parts of the illustrated matter are indicated by arrowhead lines associated with the designation numerals while specific parts are indicated by plain lines and wherein.

DESCRIPTION OF PREFERRED EMBODIMENTS

Herein the following definitions are used. "Forward" and "front" means towards the firing direction of the host rifle or suppressor (as shown in FIGS. 1-9 of the drawings as being on the right hand side of the drawings) while "rearward" or "rear" means the opposite direction from the firing direction (as shown in FIGS. 1-9 of the drawings as being on the left hand side of the drawings).

Figure 1:
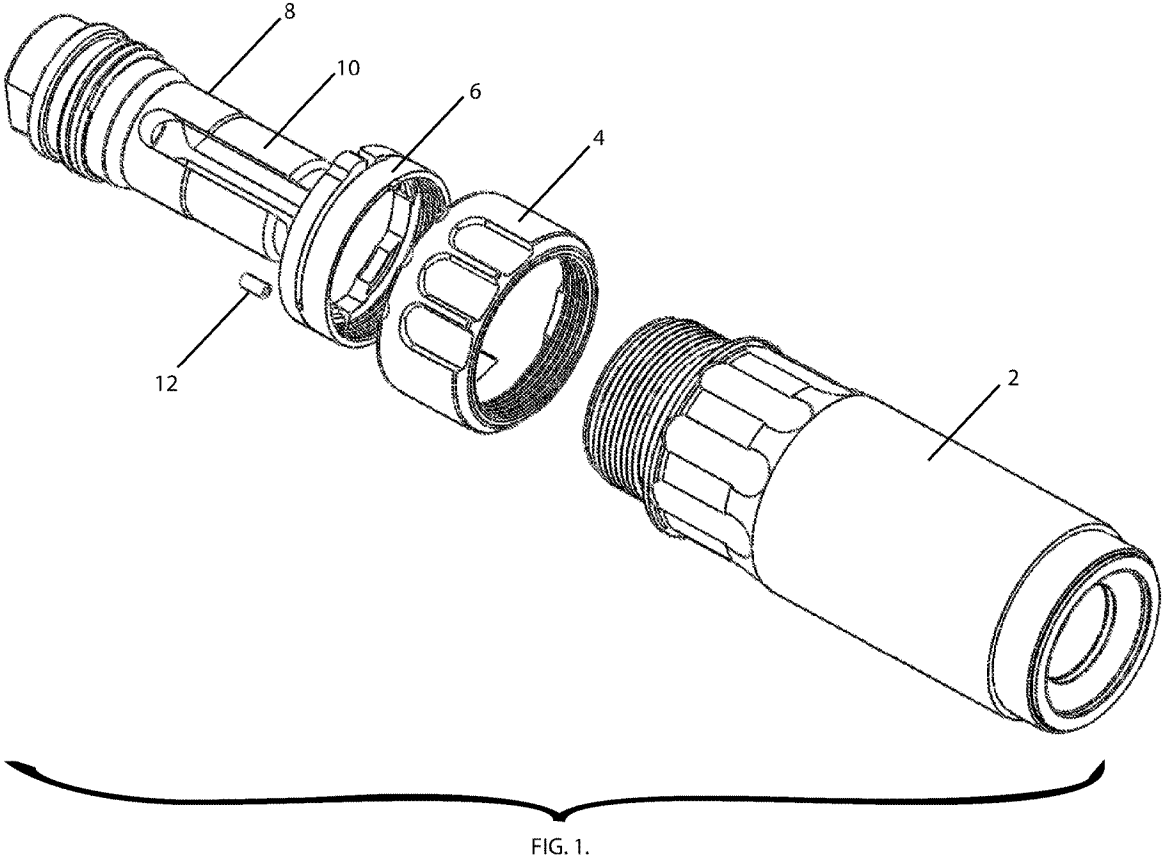
FIG. 1 is an isometric exploded view of the firearm attachment mount assembly and a flash hider.

Referring to FIG. 1, the firearm attachment mount assembly 1 is shown in a disassembled view. The mount body 2 is shown with the rotating lock collar 4 and the locking spring 6. A muzzle attachment device 8 is shown and this is a flash hider 10 though a muzzle brake or a recoil compensator may be used in place of the flash hider. A locking pin 12 is shown and this is used for locking the rotating lock collar and the locking spring together when assembled.

Figure 2:
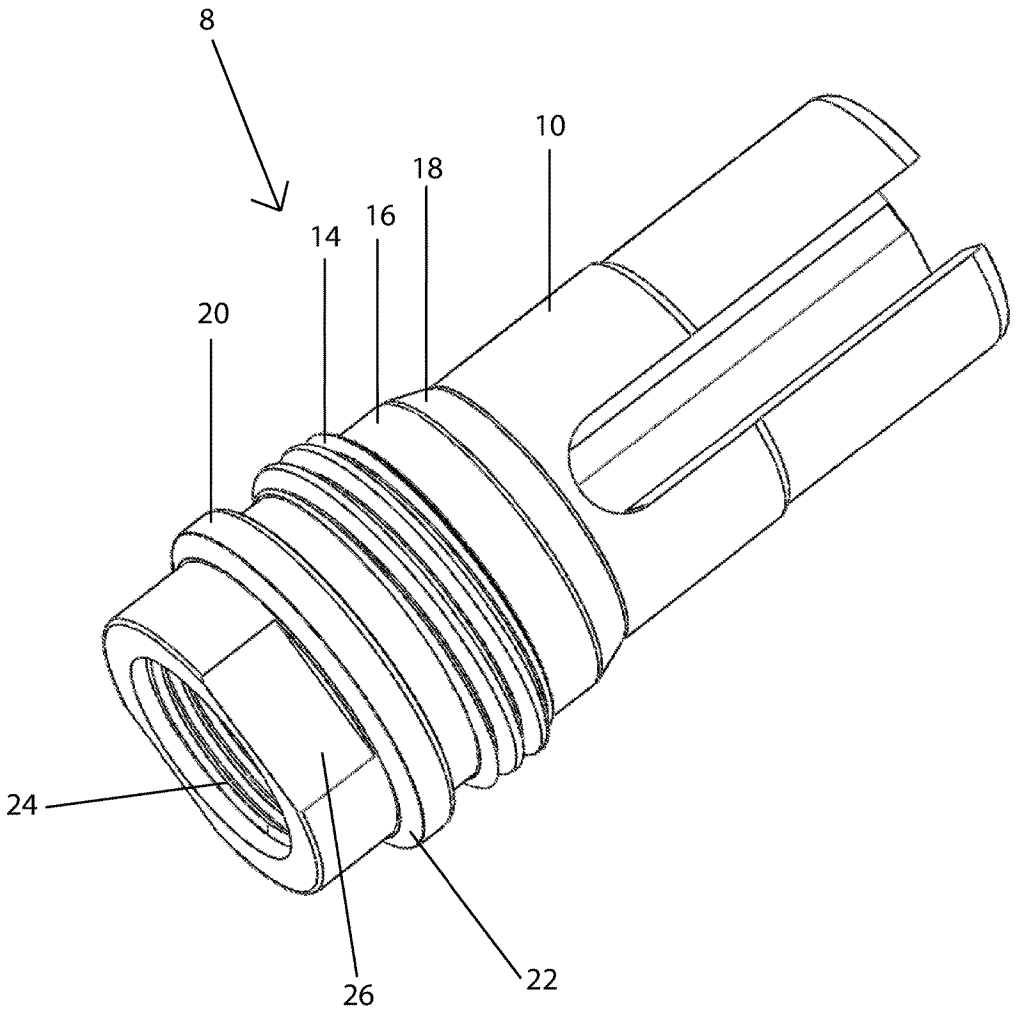
FIG. 2 is an isometric view of the flash hider which is one embodiment of a muzzle attachment device.

Referring to FIG. 2, a muzzle attachment device 8 is shown, and this is a flash hider 10. On the flash hider, there are external mounting threads 14, these threads interfacing with internal threads in the mount body. Forward of the external mounting threads, a gas seal surface 16 is positioned and a locking engagement surface 18. Although a tapered engagement surface is shown on the flash hider, it should be understood that other engagement surfaces, such as a radiused surface or a sharp shoulder may also be used, the function being that of a engagement surface that provides coaxial alignment between the mount body and the muzzle attachment device as well as being part of the locking system. At the rear of the flash hider and positioned behind the external mounting threads, a flange or elevated band 20 is positioned circumferentially. This flange or elevated band has a locking surface 22 on the rear surface of the elevated band. The flash hider is provided with internal threads 24, these being for attachment of the flash hider to the firearm. While a flash hider is shown and detailed as the muzzle attachment device, other forms of muzzle attachment devices may be used. These include a muzzle brake or a recoil compensator. The barrel of a firearm may also be used as the muzzle attachment device. These alternate muzzle attachment devices would be provided with the external mounting threads, the gas seal, the engagement surface, and the flange or elevated band with a locking surface on the rear surface of the flange. In the example of a barrel, the barrel would be machined to provide the external mounting threads, the gas seal, the engagement surface and the flange or elevated band with a locking surface on the rear surface of the flange. While the flange or elevated band as shown in FIG. 2 is larger in diameter than the external mounting threads, it should be understood that the flange or elevated band may be smaller in diameter than the diameter of the external mounting threads. The flash hider is provided with two machined wrench flats 26, 180 degrees apart and positioned rearward of the flange or elevated band. These are used to allow attachment of the flash hider to a externally threaded surface on the muzzle of the barrel of a firearm through the use of the internal threads of the flash hider. In an alternate embodiment, the flange or elevated band may be separate from the muzzle attachment device. In such an alternate embodiment, the flange may comprise a washer with a locking surface on the rear surface of the washer, and may be secured on a firearm by the muzzle attachment device by being positioned on the muzzle of a firearm between the threaded barrel and the muzzle attachment device. In yet another alternate embodiment, a additional locking surface may be provided on the proximal side of the locking surface. In this alternate embodiment, the additional locking surface may be integral with the muzzle attachment device, the additional locking surface may be the proximal or rear surface of the muzzle attachment device, the additional locking surface may be separate from the muzzle attachment device having a locking surface, or the additional locking surface integral with the barrel of a firearm. The additional locking surface and its operation is described in detail further on. In yet another alternate embodiment, the muzzle attachment device may be provided without the external mounting threads, instead using the combination of locking and engagement surfaces to secure the firearm attachment to the muzzle of a firearm.

Figure 3:
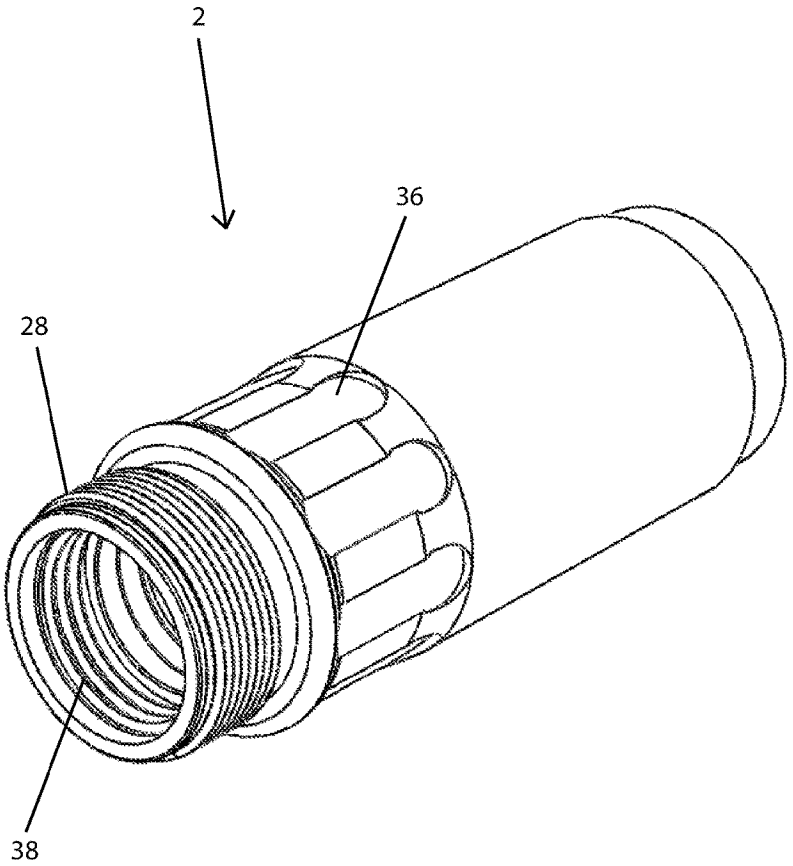
FIG. 3 is an isometric view of the firearm attachment mount body.
Figure 4:
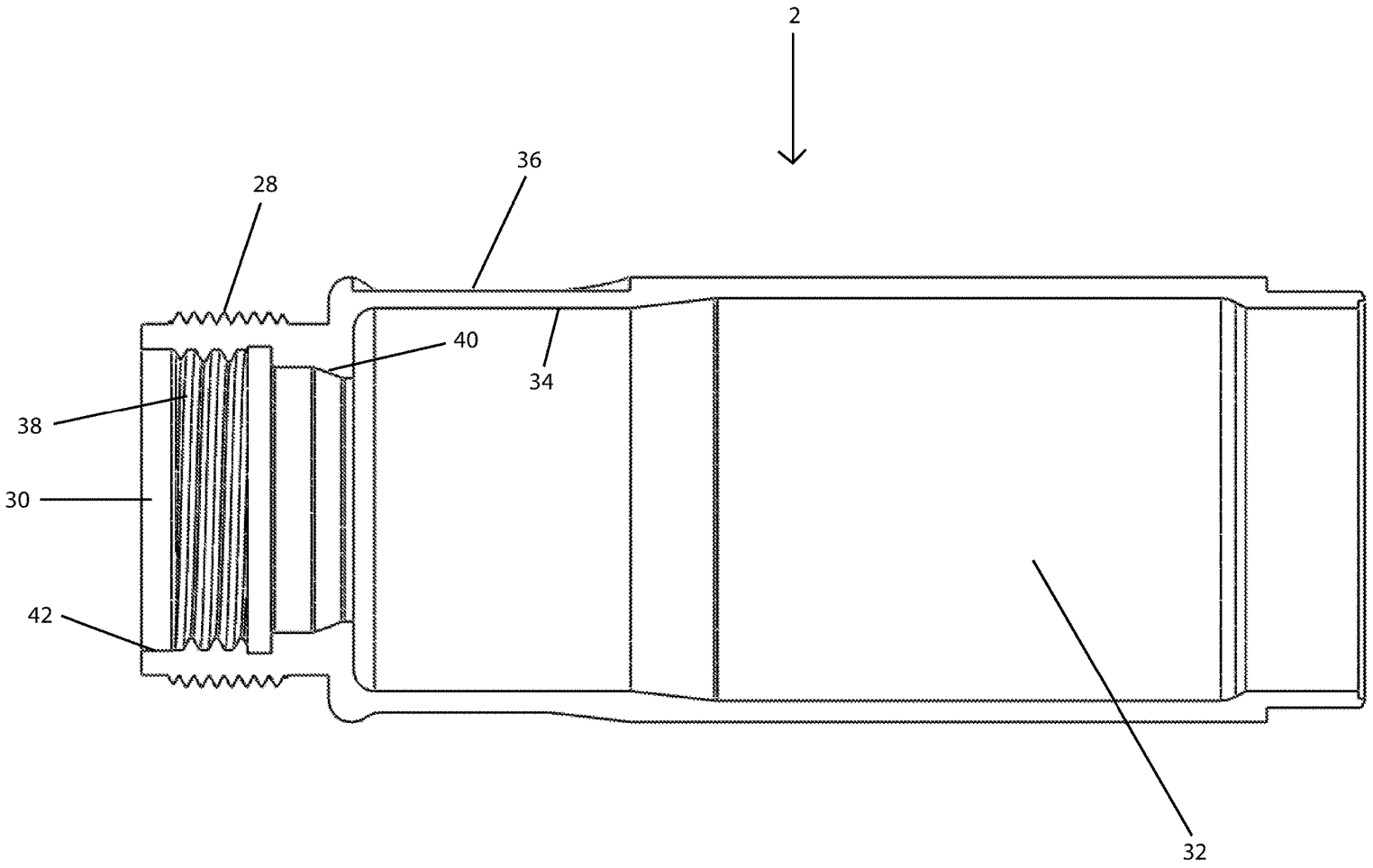
FIG. 4 is a cross section view of the firearm attachment mount body.

Referring to FIGS. 3 and 4, the firearm attachment mount body 2 is shown. At the rear of the mount body, external threads 28 are provided for the rotating collar and the locking spring. The body has a rear 30 and front 32 opening with a coaxial bore and internal surface 34. The body is provided with a plurality of machined recesses 36 in the external surface of the body, these recesses being lightening cuts to reduce the weight of the body. Positioned towards the rear opening of the mount body and in the internal surface of the mount body are the mounting threads 38, and these enable the mount to attach to the muzzle attachment device. A engagement surface 40 is positioned forward of the internal mounting threads and this engagement surface mates with the engagement surface of the muzzle attachment device. This engagement surface also provides coaxial alignment of the mount body to the muzzle attachment device. It should be understood that other engagement surfaces may be used, such as a radiused surface or a sharp shoulder to perform the functions of mating and coaxial alignment between the mount body and the muzzle attachment device. In front of the engagement surface is a gas seal surface. When the mount is attached to the muzzle attachment device, the gas seal surface butts up against the gas seal surface on the muzzle attachment device to form a gas seal, and this prevents the expanding muzzle gases from reaching the mounting threads. This in turn prevents the build-up of carbon deposits from the muzzle gases between the muzzle attachment device and the suppressor. Such a build-up of carbon will restrict the easy removing of the suppressor from the flash hider or muzzle attachment device. Directly rearward of the internal threads is a counter-bored or countersunk surface 42 which provides an additional secondary alignment surface for coaxial alignment. In an alternate embodiment, the mount body may be provided without the mounting threads, and the firearm attachment mount body secured to the muzzle by the combination of locking and engagement surfaces.

Figure 5:
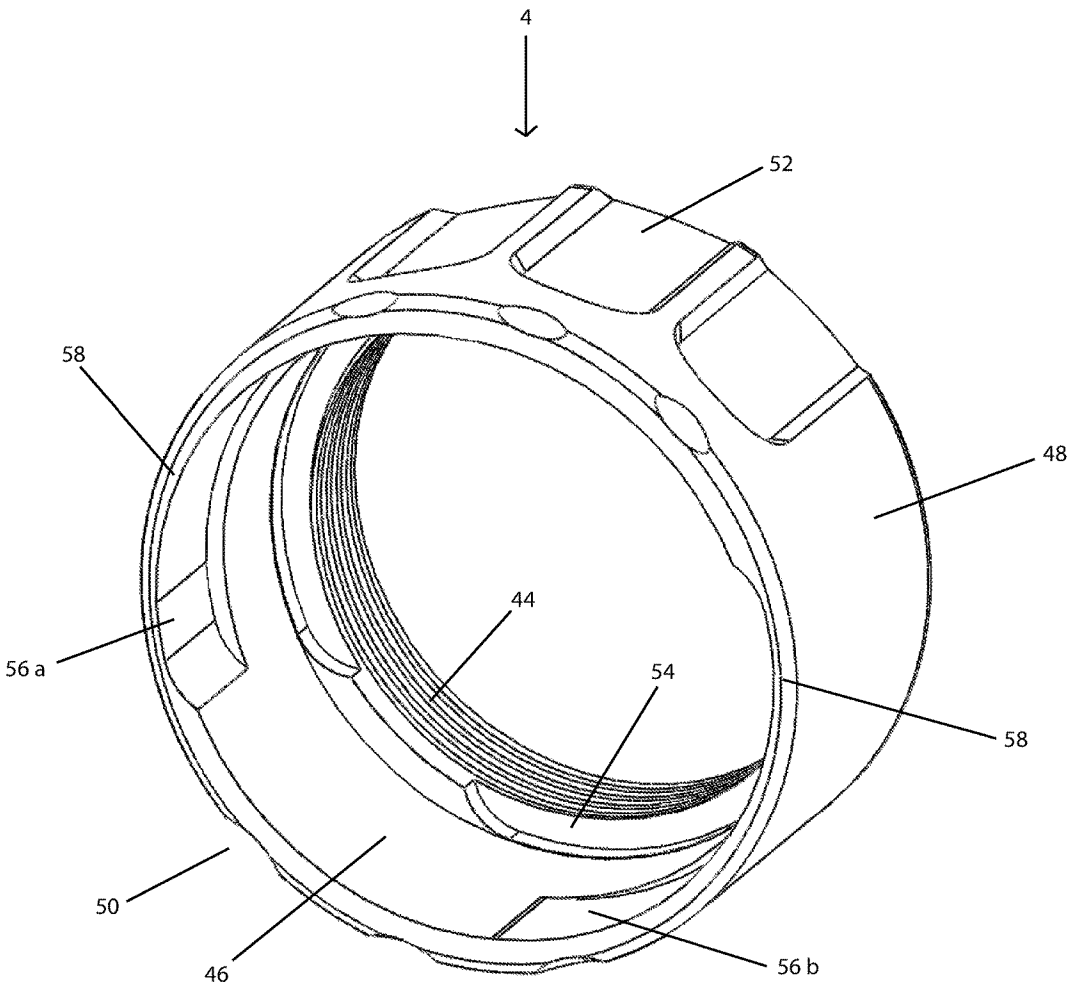
FIG. 5 is an isometric view of the front face of the rotating collar.
Figure 6:
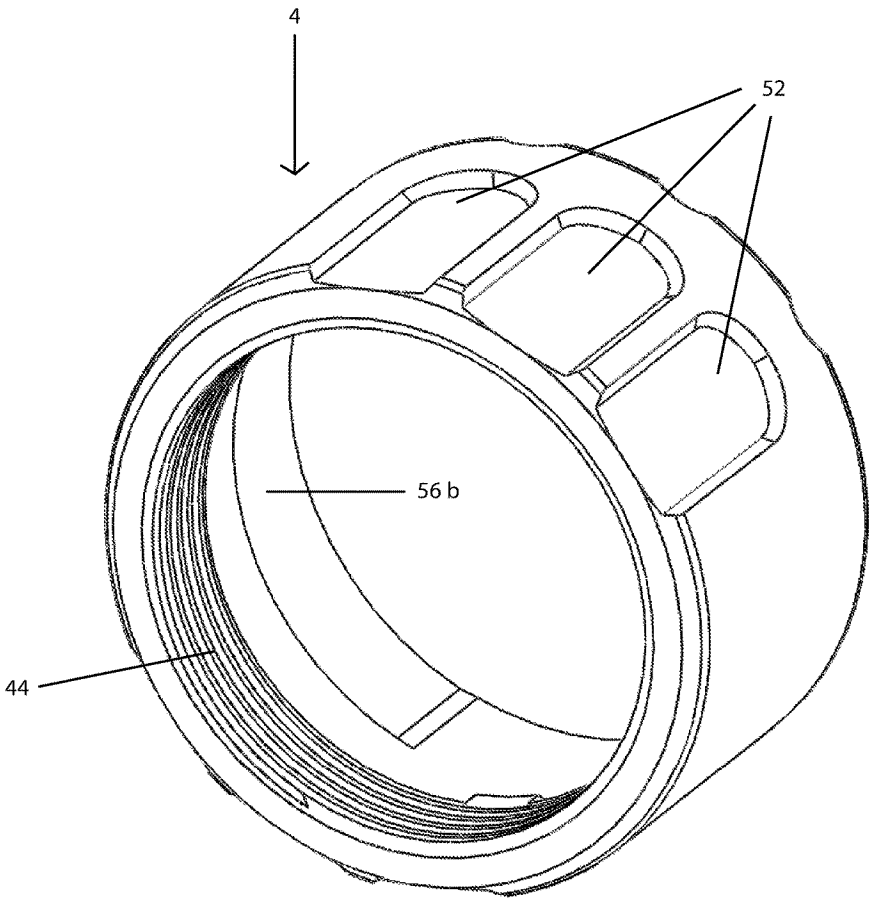
FIG. 6 is an isometric view of the rear face of the rotating collar.

Referring to FIGS. 5 and 6 of the drawings, the rotating collar 4 is shown. The collar has internal threads 44 that engage with the external threads on the mount body, and has external 46 and internal surfaces 48. The internal threads are positioned on the front side of the rotating collar. The collar has a coaxial bore hole 50 that allows the collar to pass over the muzzle attachment device. The external surface of the rotating collar 4 is provided with a plurality of machined recesses 52 to allow for firm grasping of the rotating collar when rotating the collar to lock or unlock the collar. Positioned slightly rearward of the internal threads is an axial flute or cut out 54 that is machined around the inside diameter of the collar. This axial flute curves for approximately 120 degrees. A plurality of recesses 56*a* and 56*b* are provided in the internal surface of the rotating collar close to the rear edge of the collar. These recesses are milled into the collar, are spaced apart from each other, and form cam surfaces 58 or cam slots in conjunction with the portions of the internal surface of the rotating collar that are not milled. When viewed from the rear of the collar, these surfaces are approximately 180 degrees apart from each other and are at the ten and four o'clock positions. In an alternate embodiment, the rotating collar may be provided with a non-concentric opening such that when the collar is rotated to the unlocked position, the non-concentric opening allows for passage of the collar over the muzzle of a firearm, and when the collar is rotated to the locked position, the internal rear surface of the rotating collar provides an additional locking system surface whereby the non-concentric opening locks up against the rear surface of the muzzle attachment device, or an additional locking surface which is separate from a muzzle attachment device or a barrel provided with an additional locking surface. In an alternate embodiment where the locking spring has one arm as described further on, the rotating collar would have one long cam surface to ensure that the collar is able to be turned with ease over a large rotation of the collar to lock up properly.

Figure 7:
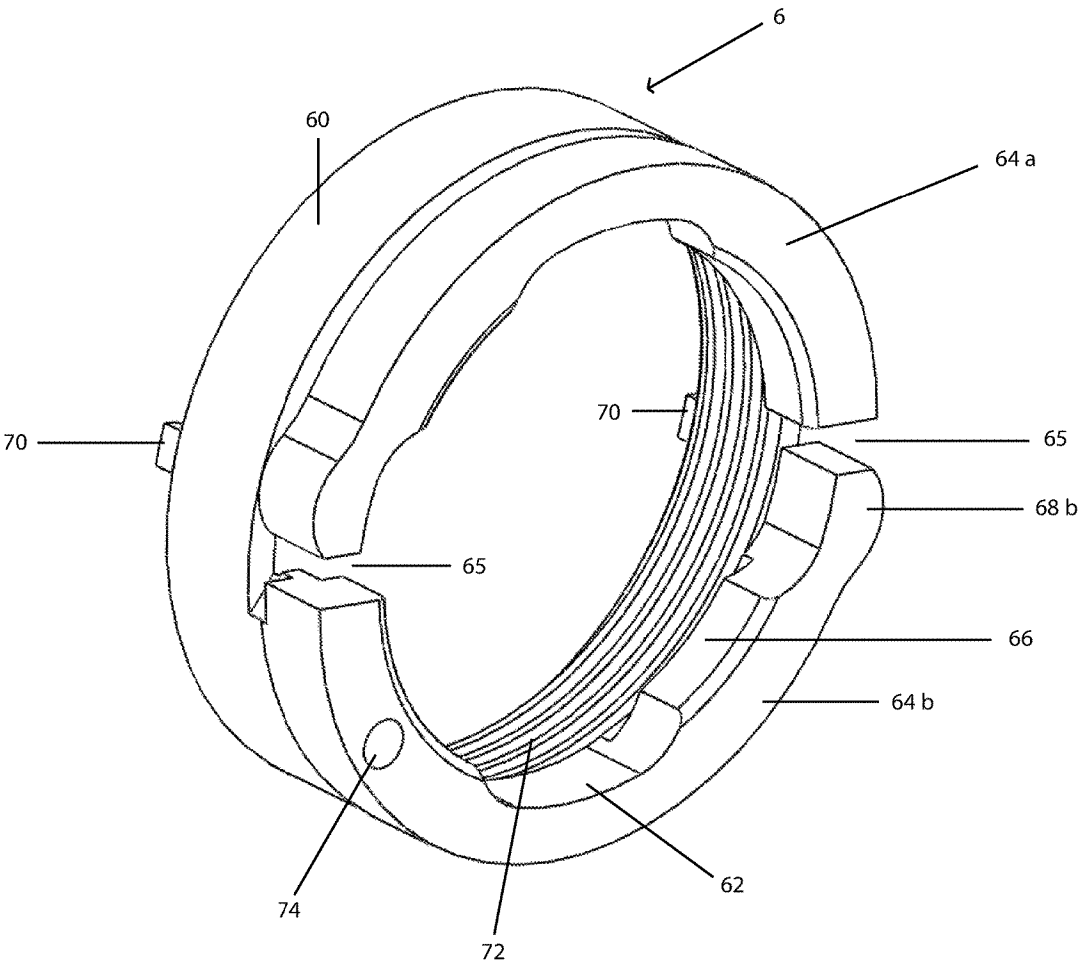
FIG. 7 is an isometric view of the front face of the locking spring.
Figure 8:
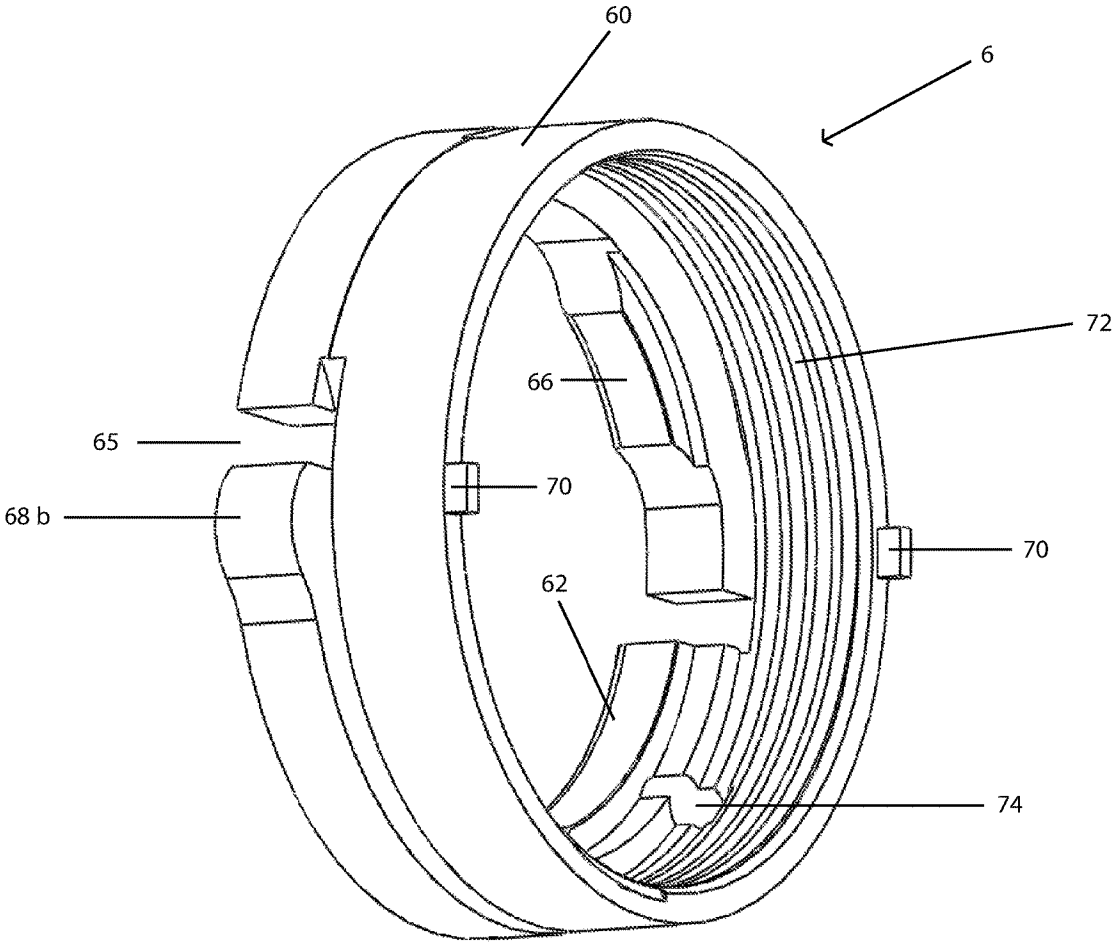
FIG. 8 is an isometric view of the rear face of the locking spring.

Referring to FIGS. 7 and 8 of the drawings, the locking spring 6 is shown. The locking spring is circular in shape, and has external 60 and internal surfaces 62 with two separate locking spring arms 64 or surfaces on the rear face of the spring, these being upper 64*a* and lower 64*b* arms. The two locking spring arms may be generally diametrically opposed to one another, as shown in FIGS. 7 and 8, and are separated from one another by a transverse cut or slot 65 through the locking spring at the nine and three o'clock positions when viewed from the rear of the locking spring. Although the locking spring is shown in FIGS. 6 and 7 as being one piece in manufacture, it should be understood that it may be of two or more pieces. These locking spring arms each have an engagement surface 66 and in the disclosed embodiment, the engagement surface is a tapered pad positioned around the middle of each locking spring arm, and the tapered surface is small in comparison to the large taper or locking surface on the rear of the muzzle attachment device, and may be generally smooth, as shown in FIGS. 7 and 8. These tapered pads or engagement surfaces engage the locking surface on the muzzle attachment device. The arms have two lobes 68*a* and 68*b* which nest in the cam slots of the rotating collar when the locking system is assembled, and these lobes are positioned 180 degrees apart and at opposing ends of each locking spring arm. The small taper is on the internal or front surface of each locking spring arm. It should be understood that in place of the tapered engagement surface on the internal surface of each locking spring arm, each arm may use a different shaped engagement surface, such as a radiused surface or a sharp surface. The two locking spring arms and the associated pads provide symmetrical clamping forces when the locking system is in use. On the front face of the spring are two small protruding tabs or teeth 70, and these tabs or teeth limit rotation of the rotating collar in conjunction with the axial flute of the rotating collar. Internal threads 72 are provided which extend from the front face of the spring rearwards to the two locking spring arms. The threads are provided to attach the locking spring to the rotating collar for a permanent installation but it should be understood that the locking spring may also have no internal threads in alternate embodiments, simply being slipped over a diameter on the mount body and pinned or otherwise secured in place without the use of the internal threads. A small hole 74 is machined through the lower arm at approximately the eight o'clock position, this being for a small locking pin 12 to lock the locking spring and rotating collar together when assembled. This hole extends through the lower locking spring arm and into the internal threads of the locking spring arm. When the locking spring arms are assembled to the rotating collar, as described in more detail below, the locking spring arm has a two-stage spring function. The two-stage spring function allows the arms to deform until the pads engage the muzzle attachment device locking surface. In an alternate embodiment, the locking spring may comprise one arm with a much greater degree of rotation to provide the greatest amount of spring deflection over the long cam surface to ensure ease of turning the collar to provide lock up.

Figure 9:
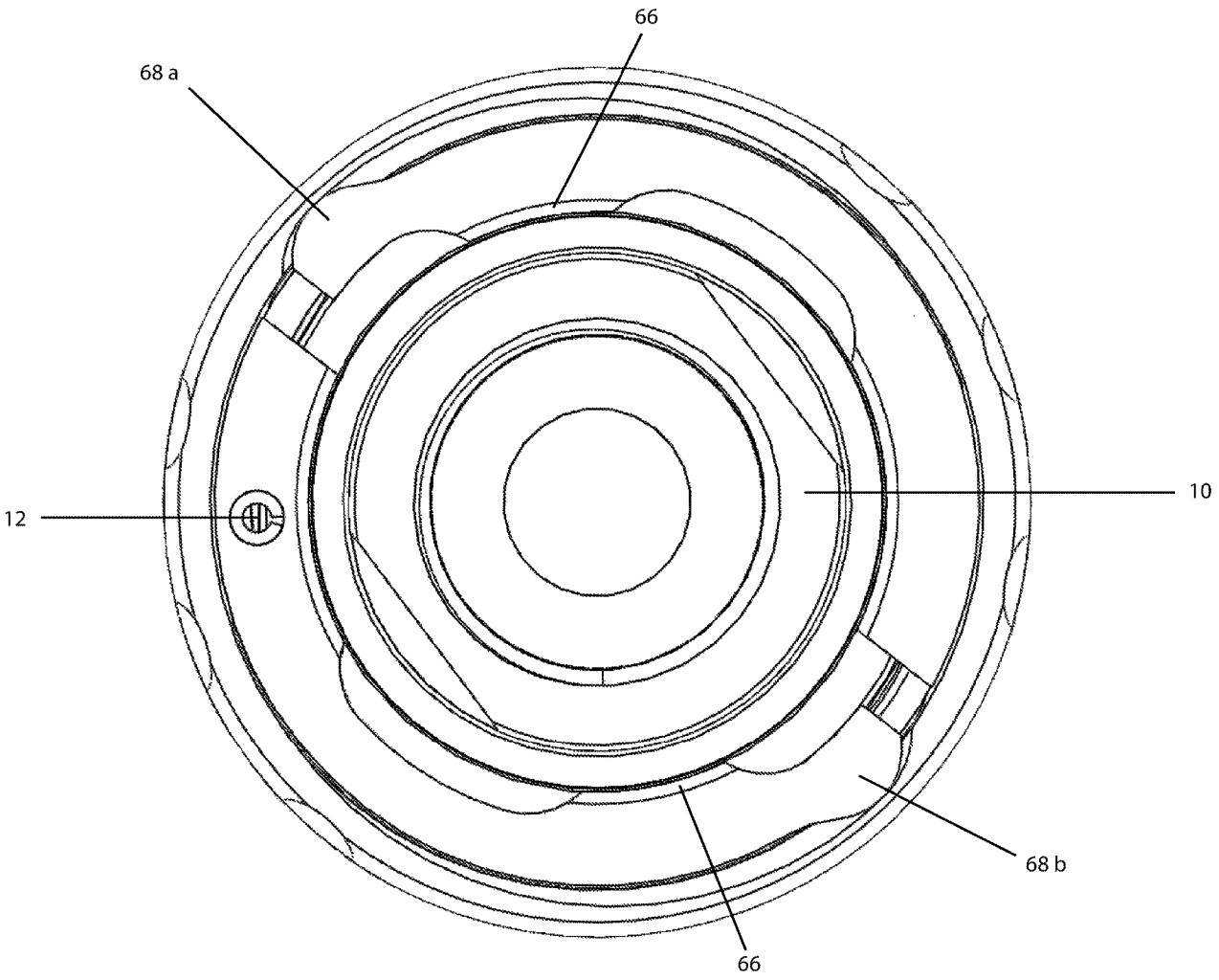
FIG. 9 is a rear end view of the mount and muzzle attachment device with the locking spring in the unlocked position.

Referring to FIG. 9 of the drawings, a rear end view of the mount with the muzzle attachment device is shown with the locking spring in an unlocked position. The two arms of the locking spring are shown positioned in the recesses of the rotating collar and the locking pin is shown on the left hand side at approximately the eight o'clock position. The two tapered pads or engagement surfaces on the arms of the locking spring are shown in their raised or unlocked position at approximately the eleven and five o'clock positions.

Figure 10:
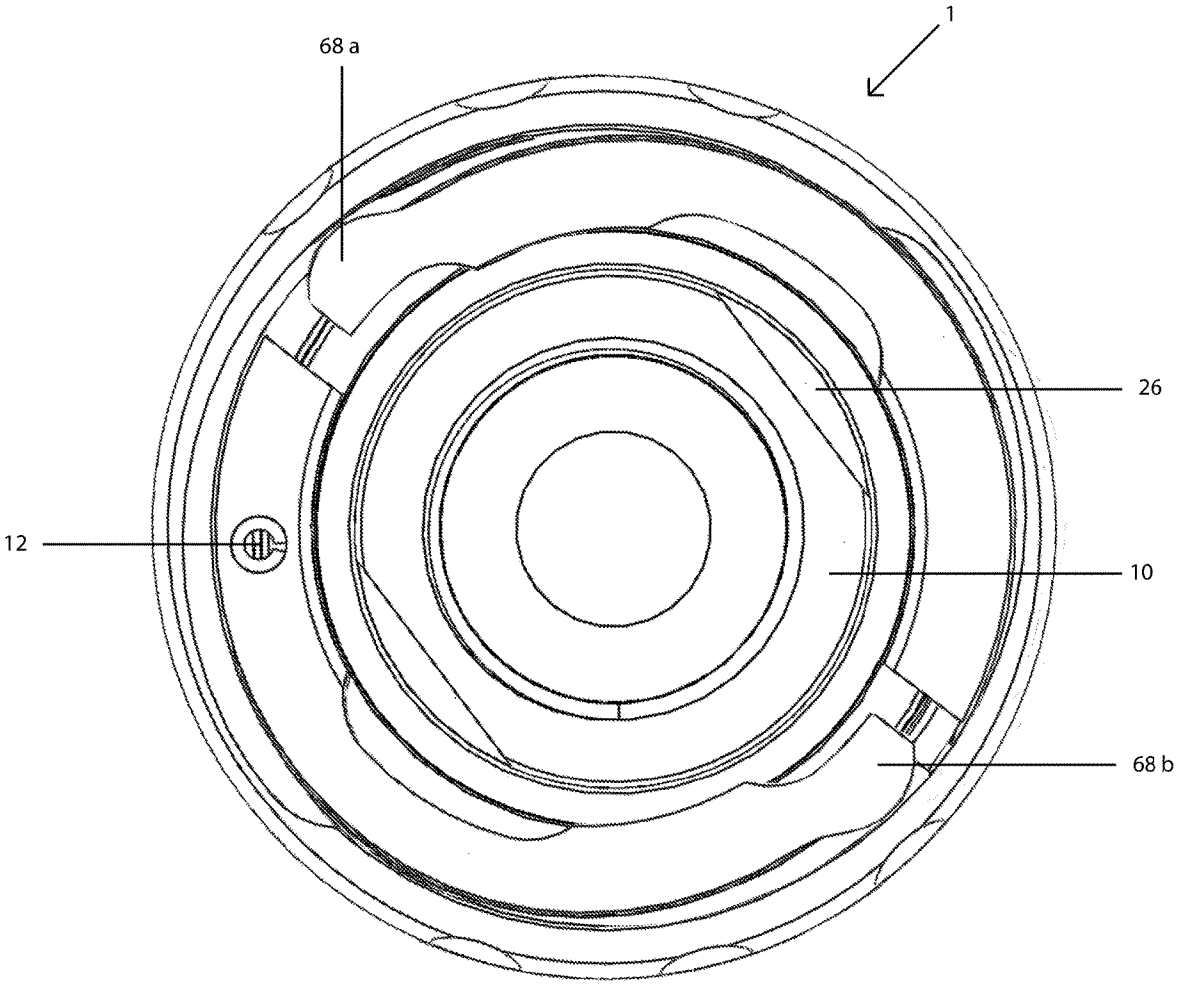
FIG. 10 is a rear end view of the firearm attachment mount and muzzle attachment device with the locking spring in the locked position.

Referring to FIG. 10 of the drawings, a rear end view of the mount with the muzzle attachment device is shown with the locking spring in a locked position. The two arms of the locking spring are shown positioned with the two tapered pads or engagement surfaces not being visible at the eleven and five o'clock positions. This is due to the tapered pads or engagement surfaces being deformed inwards due to the rotation of the rotating collar rotating forcing the arms towards the bore axis. This locks the mount and the muzzle attachment device together.

Figure 11:
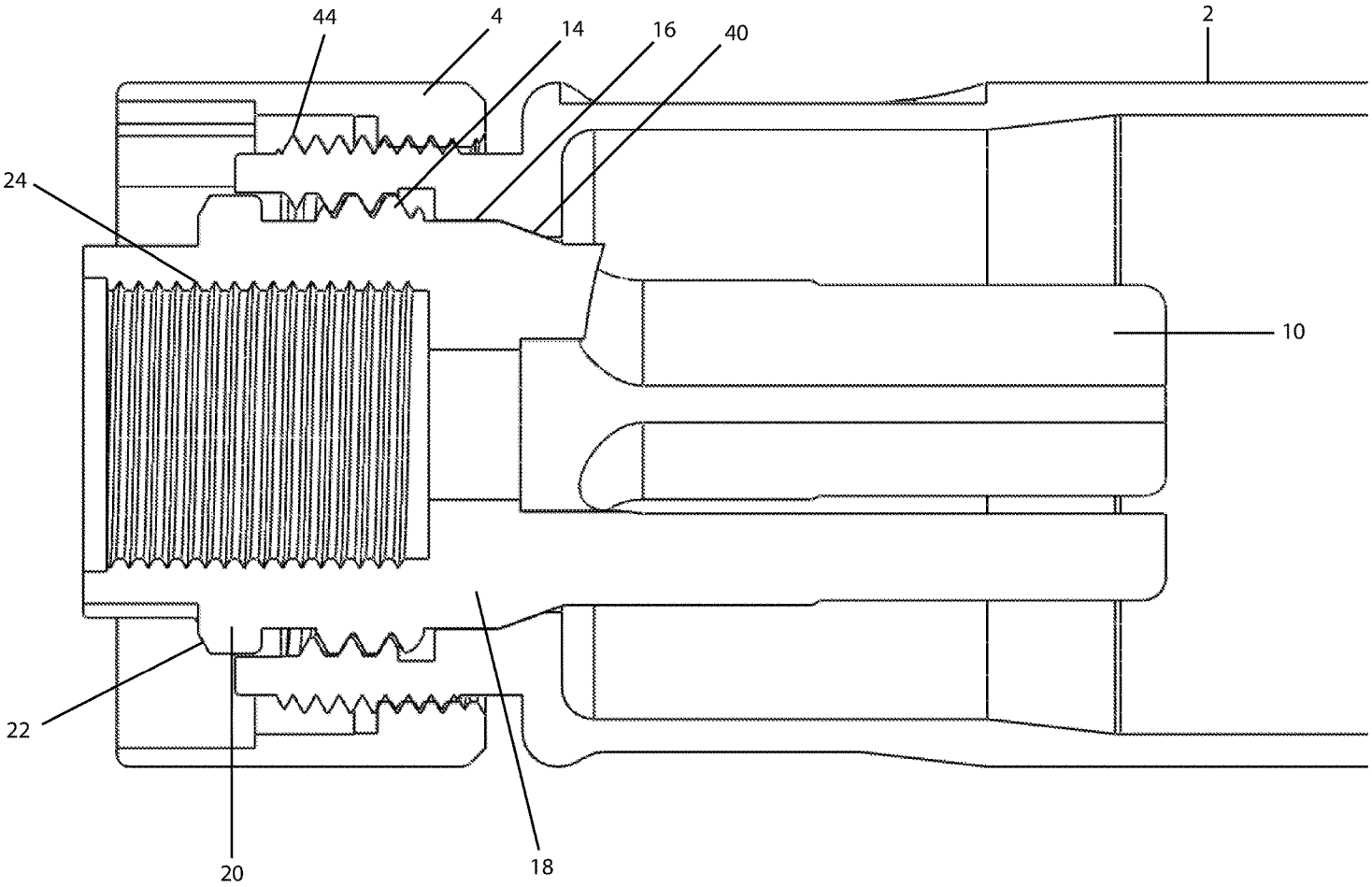
FIG. 11 is a cross section of the firearm attachment mount fitted to a flash hider or muzzle attachment device with the rotating collar but without the locking spring fitted to the mount.

Referring to FIG. 11 of the drawings, a cross section view of the firearm attachment mount fitted to a flash hider with the rotating collar attached to the mount but without the locking spring is shown. The interfacing of the muzzle attachment mount with the flash hider is shown, with the engagement surface forward of the external threads on the flash hider and the corresponding engagement surface of the mount body is clearly shown.

Figure 12:
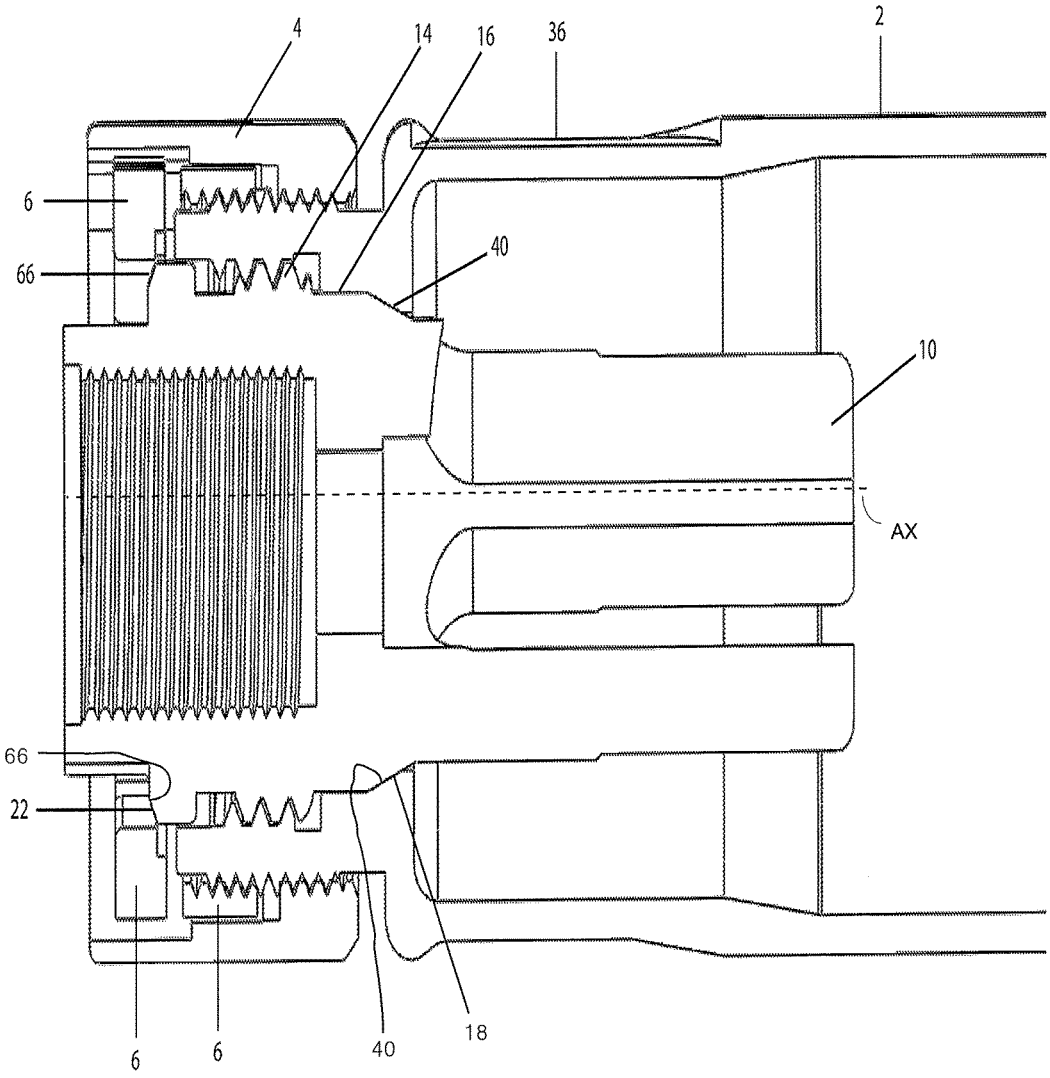
FIG. 12 is a cross section of the firearm attachment mount fitted to a flash hider or muzzle attachment device with the rotating collar with the locking spring fitted to the mount.

Referring to FIG. 12 of the drawings, a cross section view of the firearm attachment mount fitted to a flash hider with the rotating collar and the locking spring attached to the mount. The interfacing of the locking spring to the lock surface and in this instance a tapered surface on the muzzle attachment device is shown.

To assemble the device, the rotating collar 4 is partially threaded onto the mount body 2 through the external threads 28 of the mount body and the internal threads 44 of the rotating collar. The locking spring 6 is inserted into the collar. The lobes 68*a* and 68*b* of the spring nest in the cam slots 56*a* and 56*b* of the collar. The collar 4 is then threaded the remainder of the way onto the mount until the spring 6 shoulders onto the mount 2. The spring also screws onto the mount through the internal threads 72 when the collar is threaded onto the mount. This seats the locking spring 6 and collar assembly 4 onto the mount 2 and limits the collar's rotating due to the spring's protruding teeth or tabs 70. A hole is drilled into the mount using the existing hole 74 in the spring as a pilot hole. A pin 12 is then inserted to lock the assembly together. This pin 12 fits into the locking spring 6 and with the locking spring being joined to the rotating collar 4 through the protruding teeth or tabs 70, the pin locks the locking spring to the rotating collar to form the assembly.

After attachment of the rotating collar 4 to the mount body 2, the rotating collar 4 is required to be placed in an unlocked position, and this requires that the rotating collar be rotated around the longitudinal axis of the mount body 2. Rotation of the collar 4 by approximately 45 degrees or ⅛th of a turn cams both locking spring arms 64*a* and 64*b* outwards and puts the locking spring into a rest position. To place the rotating collar 4 in the locked position, the collar is rotated approximately 45 degrees or ⅛th of a turn, and this rotation cams the locking spring arms 64*a* and 64*b* inwardly towards and generally in a plane perpendicular to the bore axis of the mount. This camming action on the locking spring arms deforms the arms. The locking of the mount body 2 to the muzzle attachment device 8 is achieved through the use of the two engagement and locking surfaces (the locking surface 22 and the engagement surface 18 on the muzzle attachment device) and the spring being deformed through rotation of the collar to the locked position. When the rotating collar 4 is rotated to the locked position, the locking spring arms are deformed against the locking surface 22 and the combination of the two engagement and locking surfaces and the locking spring prevents the suppressor from rotating off the muzzle device.

However, to lock the suppressor mount system 1 to the muzzle attachment device 8, the rotating collar is rotated to the unlocked position. The suppressor can then be screwed onto the muzzle attachment device 8 until it is unable to be turned anymore. This is achieved by the engagement of the external mounting threads 14 on the muzzle attachment device 8 with the internal mounting threads 38 of the mount body 2. Once the mount body 2 is tightly screwed onto the muzzle attachment device 8, the rotating collar 4 is rotated so that the cams in the collar cam the locking spring arms 64*a* and 64*b* inwards. This in turn forces the tapered surfaces on the locking spring radially downwardly against the locking surface 22 at the rear of the muzzle attachment device 8. This loads the spring which simultaneously provides an axial force which pushes against the rear of the muzzle device in a direction towards the front opening 32 of the mount body 2. The two retention systems used in this embodiment, the thread being the primary and the tapered surfaces being the secondary, lock the suppressor and the muzzle attachment device together securely.

In an alternate embodiment where the rotating collar has a non-concentric opening, the rotating collar 4 is rotated to the unlocked position, thus allowing the suppressor mount system to pass over the muzzle attachment device and then screwed on to the muzzle attachment device 8 until it is unable to be turned anymore. Once screwed on tightly, the rotating collar 4 is rotated to the locked position, and the internal rear surface of the proximal end of the rotating collar locks up against the proximal end of a muzzle attachment device, an additional locking surface which is separate from a muzzle attachment device, or an additional locking surface which is integral with the barrel. This alternate embodiment provides a tertiary retention system.

In an alternate embodiment where the rotating collar has a non-concentric opening and the muzzle attachment device and mount system do not have threads for the mount to screw onto the muzzle attachment device, the rotating collar is rotated to the unlocked position thus allowing the suppressor mount system to pass over the muzzle attachment device in a rearward direction until it is unable to proceed any further. Once this occurs, the rotating collar is rotated to the locked position, and the internal rear surface of the proximal end of the rotating collar locks up against the proximal end of a muzzle attachment device, an additional locking surface separate from the muzzle attachment device or an additional locking surface which is integral with the barrel to secure the mount system to the muzzle.

To remove the suppressor mount system 1 from the firearm, one simply rotates the rotating collar 4 to the unlocked position, and then unscrews the suppressor mount system from the muzzle attachment device 8. It is then simply a matter of pulling the suppressor mount forward and off the muzzle attachment device. In the case of an alternate embodiment not having threads for the mount to screw onto the muzzle attachment device, one simply pulls the suppressor mount forward after rotating the collar to the unlocked position.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A firearm attachment for attachment to a muzzle of a firearm having a locking engagement surface and a locking surface connected to the muzzle, the firearm attachment comprising:

(a) a mount body defining a bore axis, a rear opening, and a front opening, and comprising a rotating locking collar attachment area and an engagement surface positioned internally in the mount body;

(b) a locking collar rotatably mounted to the attachment area of the mount body, the collar having at least one cam surface, and a bore opening at the proximal end of the collar;

(c) at least two locking spring arms biased away from the bore axis and associated with the rotating locking collar, each spring arm having a tapered engagement surface and being adapted for being moved generally perpendicular towards the bore axis upon being cammed by the at least one cam surface, whereby the tapered engagement surfaces simultaneously exert radial force and axial force against the locking surface;

(d) the engagement surface of the mount body being configured for engagement with the locking engagement surface of the muzzle; and (e) wherein the locking spring engagement surfaces are configured for engagement with the locking surface; and wherein upon engagement of the engagement surface of the mount body with the locking engagement surface, rotating the rotating locking collar cams the locking spring arms against the locking surface such that the tapered engagement surfaces both radially and axially bear against the locking surface, to selectively lock the firearm attachment to the muzzle of the firearm.

2. The firearm attachment as claimed in claim 1, wherein the rotating collar causes the locking spring arms to deform against the locking surface.

3. The firearm attachment claimed for in claim 1, wherein the engagement surface in the mount body, the locking engagement surface of the muzzle area, the engagement surfaces of the locking spring and the locking surface are tapered, a radius or sharp.

4. The firearm attachment claimed for in claim 1, wherein the rotating locking collar attachment area is threaded and the rotating locking collar has a threaded area for threadedly engaging the attachment area and is configured to be rotatably mounted to the mount body.

5. The firearm attachment as claimed for in claim 1, wherein the mount body has threaded area for threadedly engaging the muzzle.

6. The firearm attachment as claimed for in claim 1, wherein the engagement surfaces of the locking springs are generally smooth.

7. The firearm attachment as claimed for in claim 6, wherein the muzzle further comprises a gas seal area positioned on the distal side of the threaded area.

8. The firearm attachment as claimed for in claim 7, wherein the mount body further comprises a gas seal surface positioned on the distal side of the internal threaded area.

9. The firearm attachment as claimed for in claim 8, wherein the mount body further comprises a body gas seal surface positioned on the distal side on the internal threads, and wherein the body gas seal surface interfaces with the gas seal surface of the muzzle to limit muzzle gases from the firearm reaching the internal threads of the mount body.

10. The firearm attachment as claimed for in claim 1, wherein the locking surface is integral with the muzzle attachment device.

11. The firearm attachment of claim 1, wherein the rotating locking collar is rotatably mounted to the mount body having a prescribed amount of rotation for locking and unlocking the firearm attachment to the muzzle of a firearm.

12. The firearm attachment of claim 1, wherein the locking spring arms are generally diametrically opposed to one another.

13. The firearm attachment of claim 1, wherein the prescribed amount of rotation of the rotating locking collar is less than 180 degrees.

14. The firearm attachment as recited in claim 1, wherein the bore opening of the rotating collar is non-concentric to the bore axis of the firearm, the bore opening being concentric to the bore when in the unlocked position and eccentric to the bore when in the locked position.

15. The firearm attachment as recited in claim 14, wherein the firearm attachment further comprises an additional lock surface positioned on the proximal side of the locking surface positioned at the muzzle of a firearm, whereby upon rotating the collar to the unlocked position, the non-concentric opening allows passage of the firearm attachment over the muzzle of a firearm, and when the collar is rotated to the locked position, the collar engages the additional lock surface and provides an additional locking system whereby the nonconcentric opening locks up against the proximal or rear surface of the additional locking surface.

16. The firearm attachment of claim 15, wherein the additional lock surface is a substantially circular surface positioned around the bore axis of the muzzle such that when the collar is rotated to the unlocked position, the non-concentric opening allows passage of the firearm attachment over the muzzle of a firearm, and when the collar is rotated to the locked position, the collar engages the additional lock surface and provides an additional locking system surface whereby the non-concentric opening locks up against the proximal or rear surface of the additional lock surface.

17. The firearm attachment of claim 15, wherein the muzzle further comprises a muzzle attachment device wherein the additional lock surface is integral with the muzzle attachment device.

18. The firearm attachment of claim 15, wherein the additional lock surface is the proximal or rear surface of a muzzle attachment device.

19. The firearm attachment of claim 15, wherein the additional lock surface is integral with the muzzle of a firearm.

20. The firearm attachment of claim 15, wherein the additional lock surface is integral with the barrel of a firearm.

21. A suppressor for attachment to a muzzle of a firearm having a locking engagement surface and a locking surface connected to the muzzle, the firearm attachment comprising:

(a) a suppressor having a mount body defining a bore axis, a rear opening, and a front opening, and comprising a rotating locking collar attachment area and an engagement surface positioned internally in the mount body;

(b) a locking collar rotatably mounted to the attachment area of the mount body, the collar having at least one cam surface, and a bore opening at the proximal end of the collar;

(c) at least two locking spring arms biased away from the bore axis and associated with the rotating locking collar, each spring arm having a tapered engagement surface and being adapted for being moved generally perpendicular towards the bore axis generally within a plane perpendicular to bore axis upon being cammed by the at least one cam surface, whereby the tapered engagement surfaces simultaneously exert radial force and axial force against the locking surface;

(d) the engagement surface of the mount body being configured for engagement with the locking engagement surface of the muzzle; and (e) wherein the locking spring engagement surfaces are configured for engagement with the locking surface;

and wherein upon engagement of the engagement surface of the mount body with the locking engagement surface, rotating the rotating locking collar cams the locking spring arms against the locking surface such that the tapered engagement surfaces both radially and axially bear against the locking surface, to selectively lock the suppressor to the muzzle of the firearm.

22. The suppressor as claimed in claim 21, wherein the rotating collar causes the locking spring arms to deform against the locking surface.

23. The firearm suppressor as claimed for in claim 21, wherein the engagement surface in the mount body, the locking engagement surface of the muzzle area, the engagement surfaces of the locking spring and the locking surface are tapered, a radius or sharp.

24. The firearm suppressor as claimed for in claim 21, wherein the rotating locking collar attachment area is threaded and the rotating locking collar has a threaded area for threadedly engaging the attachment area and is configured to be rotatably mounted to the mount body.

25. The firearm suppressor as claimed for in claim 21, wherein the engagement surfaces of the locking springs are generally smooth.

26. The firearm suppressor as claimed for in claim 21, wherein the mount body has a threaded area for threadedly engaging the muzzle.

27. The firearm suppressor as claimed for in claim 21, wherein the muzzle further comprises a gas seal area positioned on the distal side of the threaded area.

28. The firearm suppressor as claimed for in claim 21, wherein the mount body further comprises a gas seal surface positioned on the distal side of the internal threaded area.

29. The firearm suppressor as claimed for in claim 21, wherein the mount body further comprises a body gas seal surface positioned on the distal side on the internal threads, and wherein the body gas seal surface interfaces with the gas seal surface of the muzzle to limit muzzle gases from the firearm reaching the internal threads of the mount body.

30. The firearm suppressor of claim 21, wherein the rotating locking collar is rotatably mounted to the mount body having a prescribed amount of rotation for locking and unlocking the firearm attachment to the muzzle of a firearm.

31. The firearm suppressor of claim 21, wherein the prescribed amount of rotation of the rotating locking collar is less than 180 degrees.

32. The firearm suppressor as recited in claim 21, wherein the bore opening of the rotating collar is non-concentric to the bore axis of the firearm, the bore opening being concentric to the bore when in the unlocked position and eccentric to the bore when in the locked position.

33. The firearm suppressor as recited in claim 32, wherein the firearm attachment further comprises an additional lock surface positioned on the proximal side of the locking surface positioned at the muzzle of a firearm, whereby upon rotating the collar to the unlocked position, the non-concentric opening allows passage of the firearm attachment over the muzzle of a firearm, and when the collar is rotated to the locked position, the collar engages the additional lock surface and provides an additional locking system whereby the nonconcentric opening locks up against the proximal or rear surface of the additional locking surface.

34. The firearm suppressor of claim 32, wherein the additional lock surface is a substantially circular surface positioned around the bore axis of the muzzle such that when the collar is rotated to the unlocked position, the non-concentric opening allows passage of the firearm attachment over the muzzle of a firearm, and when the collar is rotated to the locked position, the collar engages the additional lock surface and provides an additional locking system surface whereby the non-concentric opening locks up against the proximal or rear surface of the additional lock surface.

35. The firearm suppressor of claim 32, wherein the muzzle further comprises a muzzle attachment device wherein the additional lock surface is integral with the muzzle attachment device.

36. The firearm suppressor of claim 32, wherein the additional lock surface is the proximal or rear surface of a muzzle attachment device.

37. The firearm suppressor of claim 32, wherein the additional lock surface is integral with the muzzle of a firearm.

38. The firearm suppressor of claim 32, wherein the additional lock surface is integral with the barrel of a firearm.

39. A firearm attachment for attachment to a muzzle of a firearm having a locking engagement surface and a locking surface connected to the muzzle, the firearm attachment comprising:

(a) a mount body defining a bore axis, a rear opening, and a front opening, and comprising a rotating locking collar attachment area and a tapered engagement surface positioned internally in the mount body;

(b) a locking collar rotatably mounted to the attachment area of the mount body, the collar having at least one cam surface, and a bore opening at the proximal end of the collar;

(c) at least two locking spring arms biased away from the bore axis and associated with the rotating locking collar, each spring arm having a tapered engagement surface and being adapted for being moved generally perpendicular towards the bore axis generally within a plane perpendicular to bore axis upon being cammed by the at least one cam surface, whereby the tapered engagement surfaces simultaneously exert radial force and axial force against the locking surface;

(d) the engagement surface of the mount body being configured for engagement with the locking engagement surface of the muzzle; and (e) wherein the locking spring engagement surfaces are configured for engagement with the locking surface; and wherein upon engagement of the engagement surface of the mount body with the locking engagement surface, rotating the rotating locking collar cams the locking spring arms against the locking surface and deforms the locking spring arms against the locking surface such that the tapered engagement surfaces both radially and axially bear against the locking surface, to selectively lock the firearm attachment to the muzzle of the firearm.

* * * * *